US005715798A

United States Patent [19]

Bacon et al.

[11] Patent Number: 5,715,798

[45] Date of Patent: Feb. 10, 1998

[54] FUEL PUMP MANIFOLD

[75] Inventors: Donald R. Bacon, Chelmsford; Robert G. Adams, Burnham-on-Crouch; Steven M. Shortis, Billericay, all of United Kingdom

[73] Assignee: Ford Global Technologies, Inc., Dearborn, Mich.

[21] Appl. No.: 804,594

[22] Filed: Feb. 24, 1997

[51] Int. Cl.[6] ..... F02M 37/04

[52] U.S. Cl. ..... 123/514; 123/509; 137/571; 417/307

[58] Field of Search ..... 123/509, 514, 123/456; 137/569, 571, 574, 576; 417/79, 307

[56] References Cited

U.S. PATENT DOCUMENTS

| | | | |
|---|---|---|---|
| Re. 33,270 | 7/1990 | Beck et al. . | |
| 4,372,272 | 2/1983 | Walter et al. . | |
| 4,408,961 | 10/1983 | Laybourne | 417/79 |
| 4,834,132 | 5/1989 | Sasaki | 137/571 |
| 4,844,704 | 7/1989 | Jiro | 417/307 |
| 5,148,792 | 9/1992 | Tuckey | 137/569 |
| 5,195,494 | 3/1993 | Tuckey | 123/514 |
| 5,256,040 | 10/1993 | Davis | 137/569 |
| 5,289,810 | 3/1994 | Bauer | 123/514 |
| 5,361,742 | 11/1994 | Briggs et al. . | |
| 5,392,750 | 2/1995 | Laue | 123/509 |
| 5,398,655 | 3/1995 | Tuckey . | |
| 5,469,829 | 11/1995 | Kleppner | 123/514 |
| 5,477,829 | 12/1995 | Hassinger et al. . | |
| 5,613,476 | 3/1997 | Oi | 123/509 |

*Primary Examiner*—Carl S. Miller
*Attorney, Agent, or Firm*—Neil P. Ferraro

[57] ABSTRACT

A fuel pump manifold for a fuel delivery system of an automotive internal combustion engine includes a unitary housing with a fluid conduit formed therein. Inlet and outlet ports communicate with the fluid conduit, which are adapted to be connected to the outlet of a fuel pump and a fuel supply line, respectively. The fuel pump manifold further includes a jet pump supply port communicating with the fluid conduit to feed a jet pump of the fuel delivery system. To prevent fuel from draining from the fuel supply line through the manifold, a check valve is disposed within the outlet port. A pressure relief is also disposed within the fuel pump manifold to relieve excessive pressure in the fuel supply line.

20 Claims, 2 Drawing Sheets

FUEL PUMP MANIFOLD

FIELD OF THE INVENTION

This invention relates to automotive fuel delivery systems, and more particularly to fuel pump manifolds for returnless fuel delivery systems.

BACKGROUND OF THE INVENTION

Conventional automotive returnless fuel delivery systems include a valve assembly between the fuel pump and the fuel rail of the engine, which functions as a check valve and a pressure relief valve. An example of such a valve assembly is disclosed in U.S. Pat. No. 5,477,829. As disclosed therein, a multi-component housing contains a check valve, which opens upon the fuel pump delivering a predetermined pressure to the fuel line, and a pressure relief valve, which opens to relieve excessive pressure in the fuel line due to, for example, high fuel temperature in the fuel line due to what is commonly known as a "hot soak" condition.

The inventors of the present invention have found certain disadvantages with such valve assemblies. For example, in addition to being a complex, multi-component assembly requiring precise alignment of mating housing components, the valve assembly is typically located far downstream of the fuel pump, with the result that the entire fuel delivery system may not remain charged with fuel. It has been found that the further downstream the check valve portion of the valve assembly is from the fuel pump, the longer the rise time required to pressurize the system. That is, when the engine is shut off, fuel remains in the fuel line between the check valve and the engine. However, fuel between the check valve and the fuel pump may drain back to the tank, possibly causing vapor to be ingested through the housing components into the valve assembly. When the engine is subsequently started, the trapped vapor between the check valve and the fuel pump must first be evacuated or compressed before fuel is delivered to the engine, thereby increasing the time required to start the engine. This trapped vapor may also undesirably cause a vapor lock condition where no fuel is able to be delivered to the engine. Further, such valve assemblies typically occupy a relatively large amount space within the fuel tank.

Prior art fuel pump manifolds exist, such as that disclosed in U.S. Pat. No. 5,361,742, however, these manifolds make no attempt to manage the fuel returned to the tank resulting from the operation of the pressure relief valve. The inventors of the present invention have found that merely venting this fuel to the tank may cause undesirable vapor generation.

SUMMARY OF THE INVENTION

An object of the present invention is to provide a fuel pump manifold for attachment to the fuel pump which reduces the time required to pressurize the system, thereby allowing faster engine starting, while reducing vapor generation and increasing manufacturing and assembly simplicity. This object is achieved and disadvantages of prior art approaches are overcome by providing a novel fuel pump manifold for a fuel delivery system of an internal combustion engine. The fuel delivery system has a fuel delivery module mounted in a fuel tank for delivering fuel to the engine. The fuel delivery module includes a fuel pump mounted inside a reservoir for supplying fuel from the reservoir to the engine and a jet pump for supplying fuel from the tank to the reservoir.

The fuel pump manifold includes a unitary housing having an elongate fluid conduit molded therein, an inlet port communicating with the fluid conduit and connectable with an outlet of the fuel pump, an outlet port communicating with the fluid conduit and connectable to the engine, and a jet pump supply port communicating with the fluid conduit and connectable to the jet pump. A check valve is disposed within the outlet port to prevent backflow of fuel from the engine through the outlet port when the pump is not operating. The fuel pump manifold also includes a fuel pressure relief valve communicating between the outlet port downstream of the check valve and the jet pump supply port.

An advantage of the present invention is that the fuel delivery system remains charged with fuel, thereby providing a faster rise time required to pressurize the system.

Another, more specific, advantage of the present invention is that, by providing a fuel pump manifold close to the fuel pump having a unitary housing, vapor ingestion is reduced.

Still another advantage of the present invention is that a less complex fuel delivery system having a reduced number of mechanical components is provided, thereby resulting in increased manufacturing simplicity and assembly ease and a reduction in non-conforming parts production.

Another, more specific, advantage of the present invention is that package space within the fuel tank is reduced.

Other objects, features and advantages of the present invention will be readily appreciated by the reader of this specification.

BRIEF DESCRIPTION OF THE DRAWINGS

The invention will now be described, by way of example, with reference to the accompanying drawings in which.

DETAILED DESCRIPTION OF THE PREFERRED EMBODIMENTS

Figure 1:
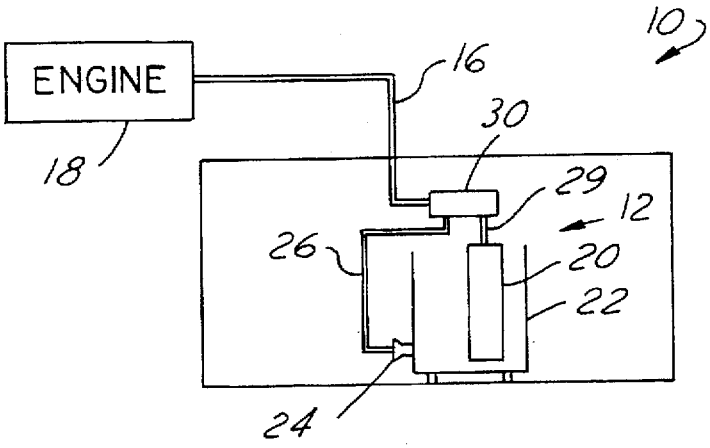
FIG. 1 is a diagrammatic representation of a fuel delivery system according to the present invention.

Fuel delivery system 10, shown in FIG. 1, includes fuel delivery module 12 mounted inside fuel tank 14. Fuel delivery module 12 delivers fuel from fuel tank 14 through line 16 to engine 18. Fuel delivery module 12 includes fuel pump 20 mounted inside of fuel reservoir 22. As is well known to those skilled in the art, reservoir 22 may include jet pump 24 mounted on a sidewall (as shown) or an underside thereof. Fuel pump 20 delivers fuel to engine 18 through fuel line 16 and to jet pump 24 through jet pump supply line 26. Thus, fuel flowing through fuel line 26 causes fuel within fuel tank 14 to become entrained within jet pump 24 so as to supply additional fuel to reservoir 22. According to the present invention, fuel pump outlet 29 of fuel pump 20 is connected to fuel pump manifold 30, which directs fuel to both engine 18 through fuel line 16 and jet pump 24 through fuel line 26.

Referring now to FIGS. 2–6, fuel pump manifold 30, preferably formed of molded plastic, includes unitary housing 34 having elongate fluid conduit 36, inlet port 38, jet pump supply port 40, and outlet port 42 molded therein. Inlet port 38, jet pump supply port 40 and outlet port 42 each communicate with fuel conduit 36 and are connectable to fuel pump outlet 29, jet pump supply line 26 and fuel supply line 16, respectively. (See FIG. 1). Outlet port 42 may include a plurality of circumferentially extending, backwardly facing rib members 44 such that outlet port 42 may be secured to a flexible fuel line 16.

Fluid conduit 36 has a substantially rectangular cross-section to aid in molding fuel pump manifold 30. During molding, a rectangular core (not shown) is inserted into the mold and occupies the space that will later define conduit 36. Similarly, cores (not shown) are inserted into the mold and occupy the spaces that will later define inlet port 38, jet pump supply port 40 and outlet port 42. Thus, the cores occupying ports 38, 40, 42 have a flat top which butts against the flat surface of the rectangular core occupying conduit 36. If the core that defines conduit 36 were cylindrical, then each core used to form ports 38, 40 and 42 would require a concave top to conform to that shape, thereby dictating a more complex and expensive molding procedure.

Figure 2:
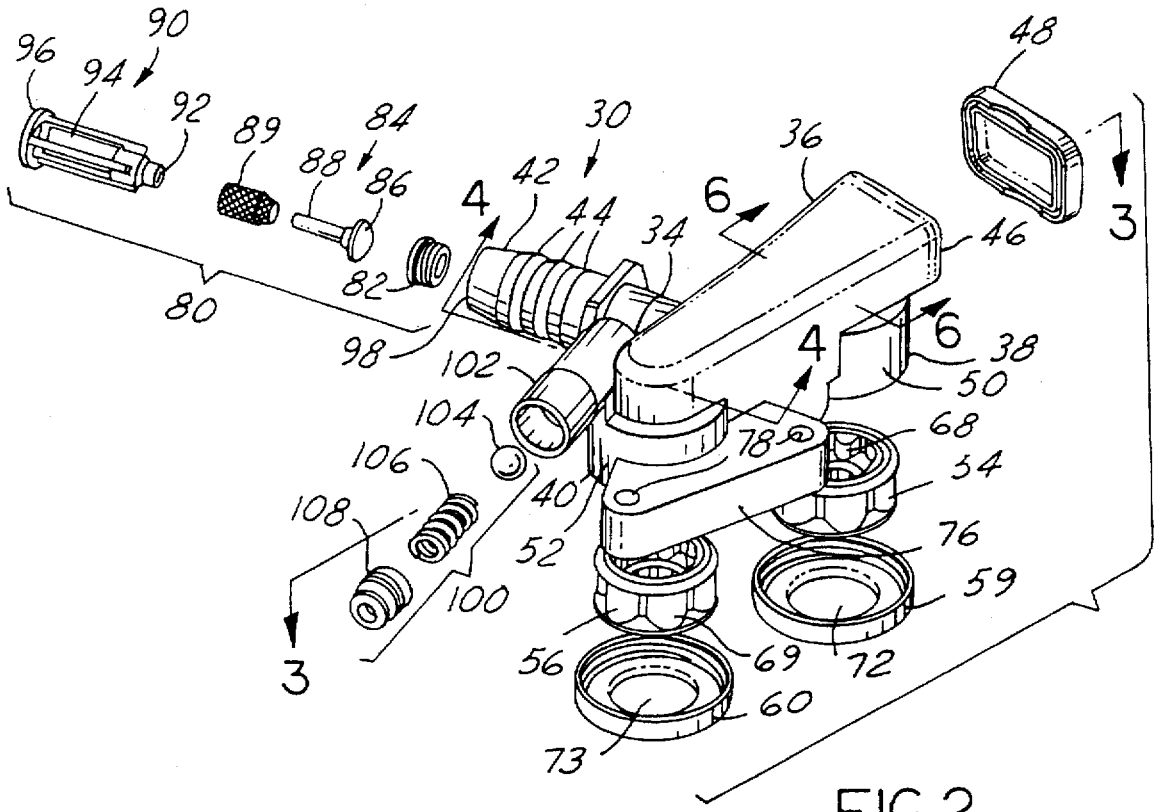
FIG. 2 is an exploded perspective view of a fuel pump manifold in a fuel delivery system according to the present invention.
Figure 3:
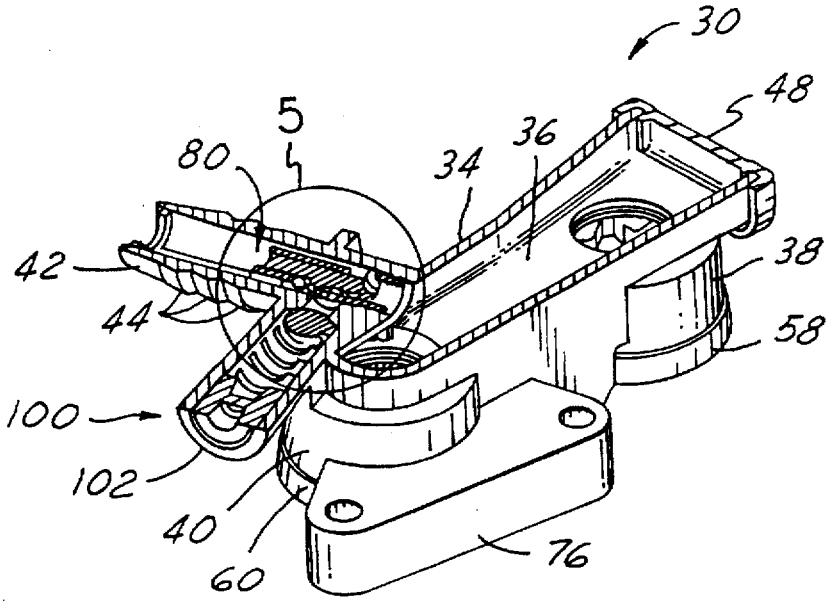
FIG. 3 is an assembled cross-sectional view taken along line 3—3 of FIG. 2.

Conduit 36 is also tapered along its length, as best shown in FIGS. 2 and 3, such that the core (not shown) that occupies the space that will later define conduit 36 may be easily removed once molding of the fuel pump manifold 30 is complete. This is accomplished by removing the core through open end 46 of fuel pump manifold 30. To close fluid conduit 36, end cap 48, made of a similar material as fuel pump manifold 30, is attached to housing 34, thereby closing end 46 of fuel pump manifold 30. In the embodiment described herein, cap 48 is sonically welded to housing 34. Of course, those skilled in the art will recognize in view of this disclosure that any suitable attaching means may be used, which provides a leak-proof manifold.

Figure 4:
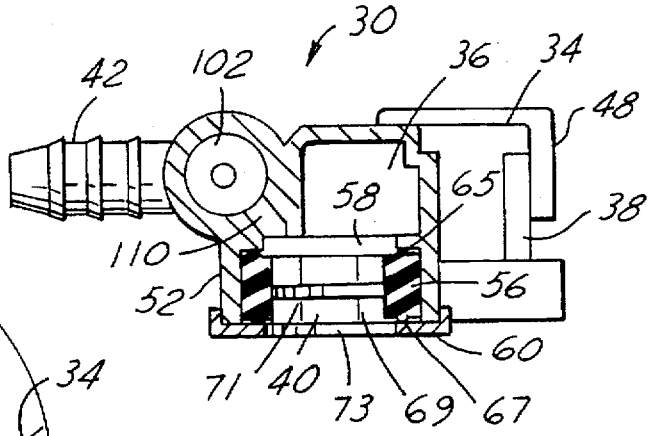
FIG. 4 is a cross-sectional view taken along line 4—4 of FIG. 2.
Figure 6:
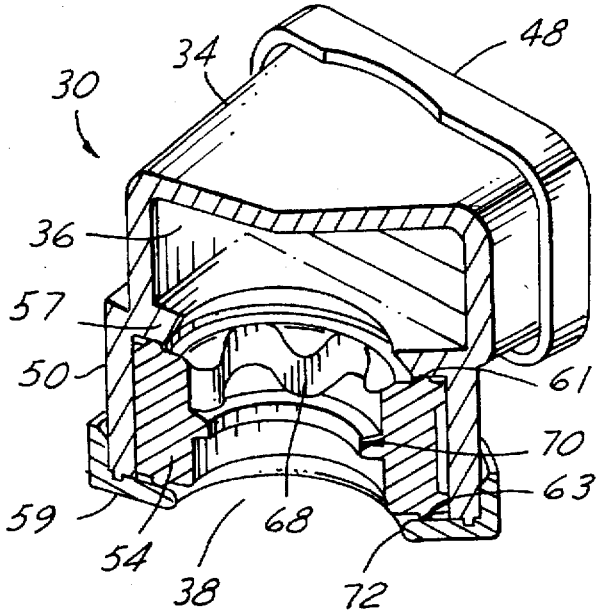

Referring now in particular to FIGS. 2, 4 and 6, fuel pump manifold 30 further includes generally cylindrical seal housings 50, 52 formed in inlet port 38 and jet pump supply port 40, respectively. Seals 54, 56 are placed within housings 50, 52 adjacent shelves 57, 58, respectively, and are held therein with seal caps 59, 60, respectively. Seals 54, 56 are used to prevent fuel from leaking out from fuel pump manifold 30, as well as preventing fuel from entering fuel pump manifold 30 from fuel tank 14. Seals 54, 56 are bi-directional, and therefore may be inserted into housings 50, 52 from either direction. That is, seal beads 61, 63, 65, 67 are located on either end of each seal 54, 56 so as to sealingly engage shelves 57, 58 and seal caps 59, 60, respectively. Seals 54, 56 further include accordion shaped sidewalls 68, 69, which are designed to flex and cooperate with seal rings 70, 71 so as to center fuel pump outlet 29 and jet pump supply line 26, respectively within housings 50, 52. Seal caps 59, 60 also have bores 72, 73, respectively, to allow fuel pump manifold 30 to be connected to fuel pump outlet 29 and jet pump line 26. In a preferred embodiment, seal caps 59, 60 are sonically welded to inlet port 38 and jet pump supply port 40, respectively. However, as would be apparent to one of ordinary skill in the art of this disclosure, seal caps 58, 60 may be attached by any suitable attaching means. Manifold 30 also includes mounting flange 76, having three mounting holes 78 (two of which are shown), integrally formed to housing 36. Mounting flange 76 facilitates mounting of fuel pump manifold 30 to the top cover of reservoir 22 (not shown).

According to the present invention, as best shown in FIG. 2, fuel pump manifold 30 includes check valve assembly 80 disposed within outlet port 42 for preventing backflow of fuel from engine 18 through outlet port 42 when pump 20 is not operating. Check valve assembly 80 includes check valve seat 82 positioned within the outlet port 42 adjacent fluid conduit 36. Of course, check valve seat 82 may be integrally formed into outlet port 42, as desired. Poppet valve 84 includes valve portion 86, which sealingly engages valve seat 82, and valve stem 88. Biasing spring 89 biases poppet valve 84 toward valve seat 82. Retaining cage 90 has an opening 92 for receiving valve stem 84 so as to guide valve stem 84 within outlet port 42. Poppet valve 84 is designed to become fully unseated when pump 20 is operating to provide maximum fuel flow with minimum resistance. To ensure that popper valve properly reseats when pump 20 is not operating, opening 92 of retaining cage 90 guides poppet valve 84 back to seat 82. Retaining cage 90 also includes a plurality of openings 94 for allowing fuel to flow past retaining cage 90. To hold check valve assembly 80 within outlet port 42, flange 96 on retaining cage 90 is heat-staked to tip 98 of outlet port 42. Of course, those skilled in the art will recognize in view of this disclosure that retaining cage 90 may be attached to tip 98 by any suitable attaching means, provided, however, that the attaching means chosen does not cause valve assembly 80 to become distorted, thereby changing the operating parameters of check valve 80.

Continuing with reference to FIG. 2, fuel pump manifold 30 further includes pressure relief valve assembly 100 disposed within an integrally formed pressure relief valve housing 102. Relief valve assembly 100 includes ball 104, biasing spring 106 for biasing ball 104 toward end cap 108 and for setting the desired predetermined relief pressure. In this example, end cap 108 is press fit into housing 102 to hold relief valve 100 in place. Relief valve assembly 100 includes ball 104 rather than a popper valve (similar to poppet valve 84) because ball 104 need only move off of its seat by a relatively small amount to relieve the pressure in line 16 (See FIG. 1).

Figure 5:
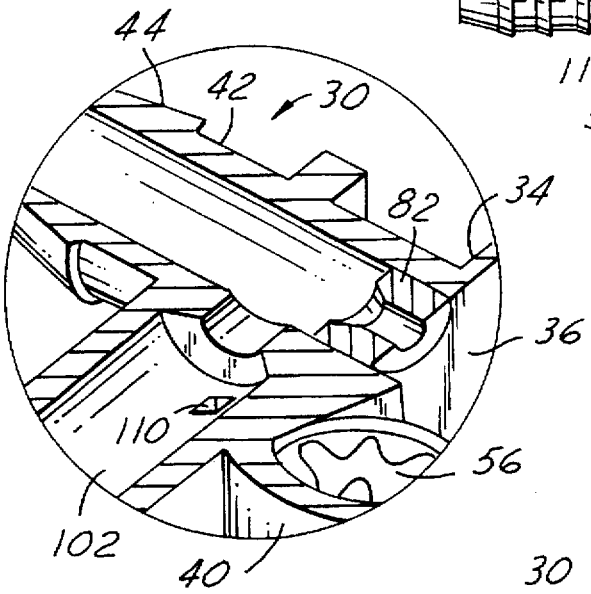
FIG. 5 is an enlarged view of the area encircled by line 5 of FIG. 3; and, FIG. 6 is an assembled cross-sectional view taken along line 6—6 of FIG. 2.

As best shown in FIG. 5, which is an enlarged view of the area encircled by line 5 of FIG. 3 with both check valve assembly 80 and pressure relief valve 100 removed for sake of clarity, pressure relief valve 100 communicates between outlet port 42 downstream of check valve 80 and jet pump supply port 40 via port 110 formed within a sidewall of housing 102. (See FIG. 4). As a result, pressure relief valve 100 is exposed to relatively equal fuel pressure on both sides thereof when pump 20 is operating and exposed to relatively unequal fuel pressure when pump 20 is not operating. This aids in increasing component life of relief valve 100. In addition, this design ensures that relief valve 100 remains closed when pump 20 is operating and can only open when pump 20 is not operating. In fact, this design allows the relief pressure set point to be less than the fuel pump operating pressure set point, if such a result is desired.

According to the present invention, when fuel pump 20 is operating, fuel is delivered from reservoir 22 to inlet port 38 of fuel pump manifold 30. Fuel then flows into conduit 36 where the fuel is then split, such that a portion of the fuel flows out of fuel pump manifold 30 into jet pump supply port 40 to supply jet pump 24 and into pressure relief housing 102 through port 110 while the remaining fuel flows past check valve assembly 80, out through outlet port 42 to fuel line 16 and finally on to engine 18. When fuel pump 20 is not operating, for example, when the engine is turned off, check valve assembly 80 prevents fuel in supply line 16 from draining. Should the pressure in fuel line 16 rise above a predetermined amount as set by the size and preload of biasing spring 106 due to, for example, a "hot soak"

condition, the pressure is relieved through pressure relief valve 100. Because of this high temperature and because of the reduction in fuel pressure as the relief valve opens, the fuel may atomize vaporize. However, rather than causing this vapor to vent directly into fuel tank 14, the vapor exits through jet pump 24 into the cooler bulk fuel in tank 14 where the vapor fuel may condense into liquid fuel. In addition, as the fuel flows through the relatively small jet pump orifice, the possibility of releasing vapor to the tank is further reduced.

While the best mode in carrying out the invention has been described in detail, those familiar with the art to which this invention relates will recognize various alternative designs and embodiments, including those mentioned above, in practicing the invention that has been defined by the following claims.

We claim:

1. A fuel delivery system for an automotive internal combustion engine comprising:

a fuel tank;

a reservoir mounted within said fuel tank;

a fuel pump disposed within said reservoir for supplying fuel from the reservoir to the engine, with said fuel pump having a fuel pump outlet;

a jet pump mounted to said reservoir and having a jet pump supply line, with a portion of the fuel flowing from said outlet of said fuel pump to said jet pump supply line, thereby powering said jet pump such that fuel is supplied from said tank to said reservoir;

a fuel pump manifold coupled to said fuel pump outlet and said jet pump supply line, with said manifold comprising:

a unitary housing having an elongate fluid conduit molded therein;

an inlet port communicating with said fluid conduit and connected to said fuel pump outlet;

an outlet port communicating with said fluid conduit and connected to the engine;

a jet pump supply port communicating with said fluid conduit and connected to said jet pump supply line, with said inlet port, said outlet port and said jet pump supply port being integrally formed with said housing;

a check valve disposed within said outlet port for preventing backflow of fuel from the engine through said outlet port when said fuel pump is not operating; and, a pressure relief valve communicating between said outlet port downstream of said check valve and said jet pump supply port, with said pressure relief valve thereby defining an outlet port side and a jet pump supply port side, with said pressure relief valve being exposed to relatively equal fuel pressure on both said outlet port side and said jet pump supply port side when said pump is operating and substantially unequal fuel pressure on both said outlet port side and said jet pump supply port side when the fuel pump is not operating.

2. A fuel delivery system according to claim 1 wherein said fuel pump manifold further comprises a pressure relief valve housing for receiving said pressure relief valve, with said pressure relief housing having a port communicating exclusively between said pressure relief valve housing and said jet pump supply port.

3. A fuel delivery system according to claim 1 wherein said inlet port and set jet pump supply port each comprises a generally cylindrical seal housing for receiving a seal and a seal cap attached to each said seal housing for at least partially encasing each said seal within said seal housing.

4. A fuel delivery system according to claim 1 wherein said fluid conduit has a substantially rectangular cross-section.

5. A fuel delivery system according to claim 4 wherein said fluid conduit is tapered along the length thereof.

6. A fuel delivery system according to claim 1 wherein said elongate fluid conduit having first and second ends, with said first end having an opening and with said fuel pump manifold further comprising an end cap attached to said housing at said first end to close said opening.

7. A fuel delivery system according to claim 1 wherein said check valve comprises:

a check valve seat positioned within said outlet port adjacent said fluid conduit;

a poppet valve having a stem, with said poppet valve sealingly engaging said check valve seat;

a check valve spring for biasing said poppet valve toward said valve seat; and, a check valve retaining cage receiving said stem of said poppet valve so as to guide said poppet valve within said outlet port, with said retaining cage having openings formed therein for allowing fuel to flow past said retaining cage.

8. A fuel pump manifold connectable with a fuel delivery system of an internal combustion engine, the fuel delivery system having a fuel tank, a reservoir disposed with the fuel tank, a fuel pump for supplying fuel to the engine and a jet pump for supplying fuel from the tank to the reservoir, with said fuel pump manifold comprising:

a unitary housing having an elongate fluid conduit formed therein;

an inlet port communicating with said fluid conduit and being connectable to an outlet of the fuel pump;

an outlet port communicating with said fluid conduit and being connectable to the engine;

a jet pump supply port communicating with said fluid conduit and being connectable to the jet pump, with said inlet port, said outlet port and said jet pump supply port being integrally formed with said housing;

a check valve disposed within said outlet port; and, a pressure relief valve communicating between said outlet port downstream of said check valve and said jet pump supply port, with said pressure relief valve thereby defining an outlet port side and a jet pump supply port side.

9. A fuel pump manifold according to claim 8 further comprising a pressure relief port communicating between said pressure relief valve and said jet pump supply port, with said pressure relief valve being exposed to substantially equal fuel pressure on both said outlet port side and said jet pump supply port side when the fuel pump is operating and substantially unequal fuel pressure on both said outlet port side and said jet pump supply port side when the fuel pump is not operating.

10. A fuel pump manifold according to claim 8 wherein said elongate fluid conduit is tapered along the length thereof and has a substantially rectangular cross-section, with said fluid conduit having first and second ends, with said first end having an opening and with said fuel pump manifold further comprising an end cap attached to said housing at said first end to close said opening.

11. A molded plastic fuel pump manifold connectable with a fuel delivery system of an automotive internal combustion engine, the fuel delivery system having a fuel delivery module mounted in a fuel tank for delivering fuel to the engine, the fuel delivery module having a fuel pump mounted inside a reservoir for supplying fuel from the reservoir to the engine and a jet pump for supplying fuel from the tank to the reservoir, with said fuel pump manifold comprising:

a unitary housing having an elongate fluid conduit molded therein;

an inlet port communicating with said fluid conduit and being connectable to an outlet of the fuel pump;

an outlet port communicating with said fluid conduit and being connectable to the engine;

a jet pump supply port communicating with said fluid conduit and being connectable to the jet pump, with said inlet port, said outlet port and said jet pump supply port being integrally formed with said housing;

a check valve disposed within said outlet port for preventing backflow of fuel from the engine through said outlet port when the pump is not operating; and, a pressure relief valve communicating between said outlet port downstream of said check valve and said jet pump supply port, with said pressure relief valve thereby defining an outlet port side and a jet pump supply port side, with said pressure relief valve being exposed to relatively equal fuel pressure on both said outlet port side and said jet pump supply port side when said pump is operating and substantially unequal fuel pressure on both said outlet port side and said jet pump supply port side when the fuel pump is not operating.

12. A fuel pump manifold according to claim 11 further comprising a pressure relief valve housing for receiving said pressure relief valve, with said pressure relief housing having a port communicating exclusively between said pressure relief valve housing and said jet pump supply port.

13. A fuel pump manifold according to claim 11 wherein said inlet port and set jet pump supply port each comprises a generally cylindrical seal housing for receiving a seal.

14. A fuel pump manifold according to claim 13 further comprising a seal cap attached to each said seal housing for at least partially encasing each said seal within said seal housing.

15. A fuel pump manifold according to claim 11 wherein said fluid conduit has a substantially rectangular cross-section.

16. A fuel pump manifold according to claim 15 wherein said fluid conduit is tapered along the length thereof.

17. A fuel pump manifold according to claim 11 wherein said elongate fluid conduit has first and second ends, with said first end having an opening and with said fuel pump manifold further comprising an end cap attached to said housing at said first end to close said opening.

18. A fuel pump manifold according to claim 17 wherein said inlet port is positioned adjacent said first end and wherein said jet pump supply port is positioned adjacent said second end.

19. A fuel pump manifold according to claim 18 wherein said check valve and said pressure relief valve are positioned adjacent said second end.

20. A fuel pump manifold according to claim 11 wherein said check valve comprises:

a check valve seat positioned within said outlet port adjacent said fluid conduit;

a poppet valve having a stem, with said poppet valve sealingly engaging said check valve seat;

a check valve spring for biasing said poppet valve toward said valve seat; and, a check valve retaining cage receiving said stem of said poppet valve so as to guide said poppet valve within said outlet port, with said retaining cage having an opening formed therein for allowing fuel to flow past said retaining cage.

* * * * *